US012642366B2

(12) United States Patent
Nottingham et al.

(10) Patent No.: US 12,642,366 B2
(45) Date of Patent: Jun. 2, 2026

(54) MERCHANDISE DISPLAY FOR DISPLAYING, REFRIGERATING, AND DISPENSING CONTAINERS OF A FROZEN PRODUCT

(71) Applicant: Mars, Incorporated, McLean, VA (US)

(72) Inventors: Bill Nottingham, Cleveland, OH (US); Bill Rabbitt, Cleveland, OH (US); Lindsey Tufts, Cleveland, OH (US); Nick Stanca, Cleveland, OH (US); Henry Izzo, Hackettstown, NJ (US); Carter Calico, Rogers, AR (US)

(73) Assignee: Mars, Incorporated, McLean, VA (US)

( * ) Notice: Subject to any disclaimer, the term of this patent is extended or adjusted under 35 U.S.C. 154(b) by 694 days.

(21) Appl. No.: 17/630,992

(22) PCT Filed: Jul. 31, 2020

(86) PCT No.: PCT/US2020/044483

§ 371 (c)(1),
(2) Date: Jan. 28, 2022

(87) PCT Pub. No.: WO2021/022152

PCT Pub. Date: Feb. 4, 2021

(65) Prior Publication Data

US 2022/0183481 A1 Jun. 16, 2022

Related U.S. Application Data

(60) Provisional application No. 62/497,353, filed on Aug. 1, 2019.

(51) Int. Cl.
*A47F 3/04* (2006.01)
*A47F 3/02* (2006.01)

(52) U.S. Cl.
CPC ..... *A47F 3/0404* (2013.01); *A47F 3/02* (2013.01); *A47F 3/0434* (2013.01)

(58) Field of Classification Search
CPC ..... A47F 3/0434; A47F 3/02; A47F 3/0404; A47F 3/0439; A47F 3/007; A47F 3/0452;
(Continued)

(56) References Cited

U.S. PATENT DOCUMENTS 2,534,488 A * 12/1950 Weber ..... A47F 3/043 312/307
2,661,119 A * 12/1953 Spiess, Jr. ..... B65D 43/20 220/815

(Continued)

FOREIGN PATENT DOCUMENTS

EP 2092861 A1 8/2009
NO 300353 B1 * 5/1997 ..... F25D 25/025

(Continued)

*Primary Examiner* — Hiwot E Tefera
(74) *Attorney, Agent, or Firm* — Baker Botts L.L.P.

(57) ABSTRACT

A merchandise display for displaying, refrigerating, and dispensing containers of a frozen product along an aisle may include a) a lower shelf and b) an upper shelf disposed above the lower shelf along a longitudinal axis of the merchandise display, c) a support portion operably coupled to the lower shelf and the upper shelf to form an assembly, radial extent of the assembly from the longitudinal axis forming a radial envelope of the merchandise display, and d) at least one refrigerating appliance configured to keep the frozen product frozen, disposed on the lower shelf or the upper shelf, and including a door configured to be moved between opened and closed positions to expose and close, respectively, the refrigerating chamber remaining within the radial envelope of the merchandise display.

20 Claims, 8 Drawing Sheets

(58) Field of Classification Search
CPC ..... A47F 3/063; A47F 3/0408; A47F 10/02; A47F 3/0456; A47F 3/0491; A47F 3/0443; A47F 3/043; A47F 3/145; A47F 3/0413; A47F 3/0486; A47F 2003/0473; A47F 3/04; A47F 3/0482; F25D 19/04; F25D 2331/804; F25D 3/06; F25D 25/005; F25D 23/026; F25D 23/021; F25D 25/021; B65D 43/20; B65D 43/14; B65D 43/16
See application file for complete search history.

(56) References Cited

U.S. PATENT DOCUMENTS 2,793,925 A * 5/1957 Rosen ..... A47F 3/043 312/139.2
2,891,834 A * 6/1959 Lake ..... F25D 23/021 312/307
2,973,631 A 3/1961 Adkins
3,010,290 A 11/1961 Fredrick
3,208,809 A * 9/1965 Quimper ..... F25D 23/026 312/295
3,295,907 A * 1/1967 Galvin ..... A47F 3/043 312/298
3,366,268 A * 1/1968 Struck ..... A45D 27/22 220/345.5
3,552,138 A * 1/1971 Davis ..... A47F 3/0469 62/252
3,729,243 A * 4/1973 Musgrave ..... A47F 3/043 312/321.5
4,628,697 A * 12/1986 Bruck ..... A47F 3/0447 220/252
4,798,425 A * 1/1989 Armstrong ..... F25D 23/04 312/328
4,949,554 A * 8/1990 Branz ..... F25D 21/04 62/298
5,129,235 A * 7/1992 Renken ..... F25D 19/04 454/91
5,201,191 A 4/1993 Bustos
5,301,517 A * 4/1994 Bustos ..... A47F 3/0408 62/251
5,499,513 A 3/1996 Bustos
5,673,811 A * 10/1997 Dickinson ..... B65D 43/164 220/815
5,890,613 A * 4/1999 Williams ..... A45C 7/0045 220/23.4
6,014,867 A 1/2000 Floeysvik
6,128,912 A * 10/2000 Wetzel ..... A47F 3/0447 62/256
6,260,694 B1 * 7/2001 Sasahara ..... A47F 10/06 198/860.3
6,736,261 B1 * 5/2004 Thomas ..... B65D 85/10 229/87.01
7,673,769 B2 * 3/2010 McRorie, III ..... B65F 1/1607 220/812
7,789,238 B2 * 9/2010 Claypool ..... A47J 47/04 206/508
7,878,018 B2 2/2011 Park
8,152,257 B2 * 4/2012 Kim ..... F25D 23/04 312/405.1
8,960,824 B2 2/2015 Wilcox
RE45,742 E * 10/2015 Behr ..... A47F 3/0434
9,347,704 B2 5/2016 Mok et al.
9,738,425 B2 * 8/2017 Shrader ..... B65D 43/16
2002/0190619 A1 * 12/2002 Brauer ..... A47F 3/0434 220/592.02
2005/0052099 A1 * 3/2005 Behr ..... A47F 3/0434 312/139.2
2005/0126196 A1 * 6/2005 Grassmuck ..... A47F 3/0443 62/298
2005/0217297 A1 * 10/2005 Wilson ..... A47F 3/0443 62/255
2006/0124653 A1 * 6/2006 McRorie, III ..... B65F 1/1607 220/735
2006/0273706 A1 12/2006 Champagne et al.
2007/0051726 A1 * 3/2007 Arkins ..... B65D 43/20 220/788
2007/0272634 A1 * 11/2007 Richter ..... A47F 1/126 211/59.3
2008/0197040 A1 * 8/2008 Lin ..... B65D 43/20 206/509
2009/0039040 A1 * 2/2009 Johnson ..... A47F 1/126 211/134
2010/0072206 A1 * 3/2010 Doyle ..... B65D 25/54 220/345.2
2015/0101359 A1 * 4/2015 Iyengar ..... A47F 3/0408 62/251
2016/0114941 A1 * 4/2016 White ..... B65D 43/0202 29/434
2016/0153704 A1 * 6/2016 Burke ..... A47B 88/70 312/404
2016/0348956 A1 * 12/2016 Toschek ..... F25D 23/026
2019/0290021 A1 * 9/2019 Olesen ..... F25D 23/026
2020/0337817 A1 * 10/2020 Swift ..... A47B 88/994
2022/0104636 A1 * 4/2022 Chila ..... G16H 40/40

FOREIGN PATENT DOCUMENTS

RU 2560271 C1 8/2015
WO WO-2007050089 A1 * 5/2007 ..... B25H 3/025
WO 2009090162 A1 7/2009

* cited by examiner

MERCHANDISE DISPLAY FOR DISPLAYING, REFRIGERATING, AND DISPENSING CONTAINERS OF A FROZEN PRODUCT

BACKGROUND

Grocery stores, convenience stores, etc. use merchandise displays to display products to be sold to the public. Conventionally, frozen products (e.g., ice cream, ice cream bars, frozen candy, etc.) were limited to being displayed in relatively large freezers because of the bulk of refrigerating/freezing equipment. These freezers typically have out swinging doors that occupy some of the aisle when opened. Thus, conventionally, frozen products were limited to being displayed in relatively large aisles that could accommodate the large freezers and the out-swinging doors associated with them.

SUMMARY OF THE INVENTION

A problem the inventors of the present disclosure encountered is that conventional displays did not allow for displaying frozen products along, for example, a narrow aisle such as check-out aisle at a grocery store. Conventional displays for frozen products just consumed too much floor space. The merchandise display disclosed herein allows for displaying frozen products along, for example, a narrow aisle such as check-out aisle at a grocery store. Use of the merchandise display disclosed herein may allow for displaying frozen products next to, for example, candy, gum, and other products typically found displayed along the check-out aisle at a grocery store. The invention(s) disclosed herein may provide these and other advantages over the prior art.

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
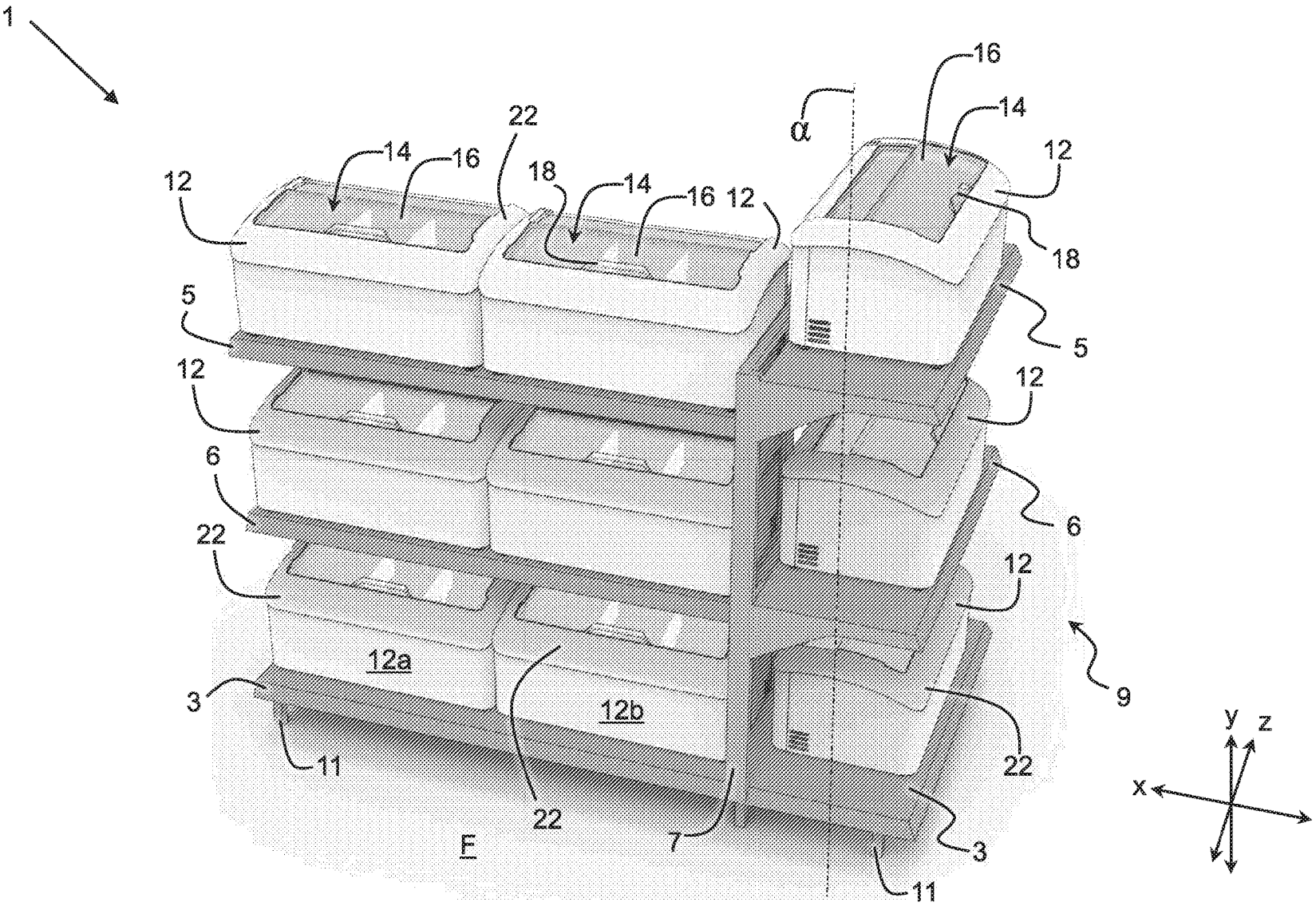
FIG. 1 illustrates a perspective view of an exemplary merchandise display with closed doors.
Figure 2:
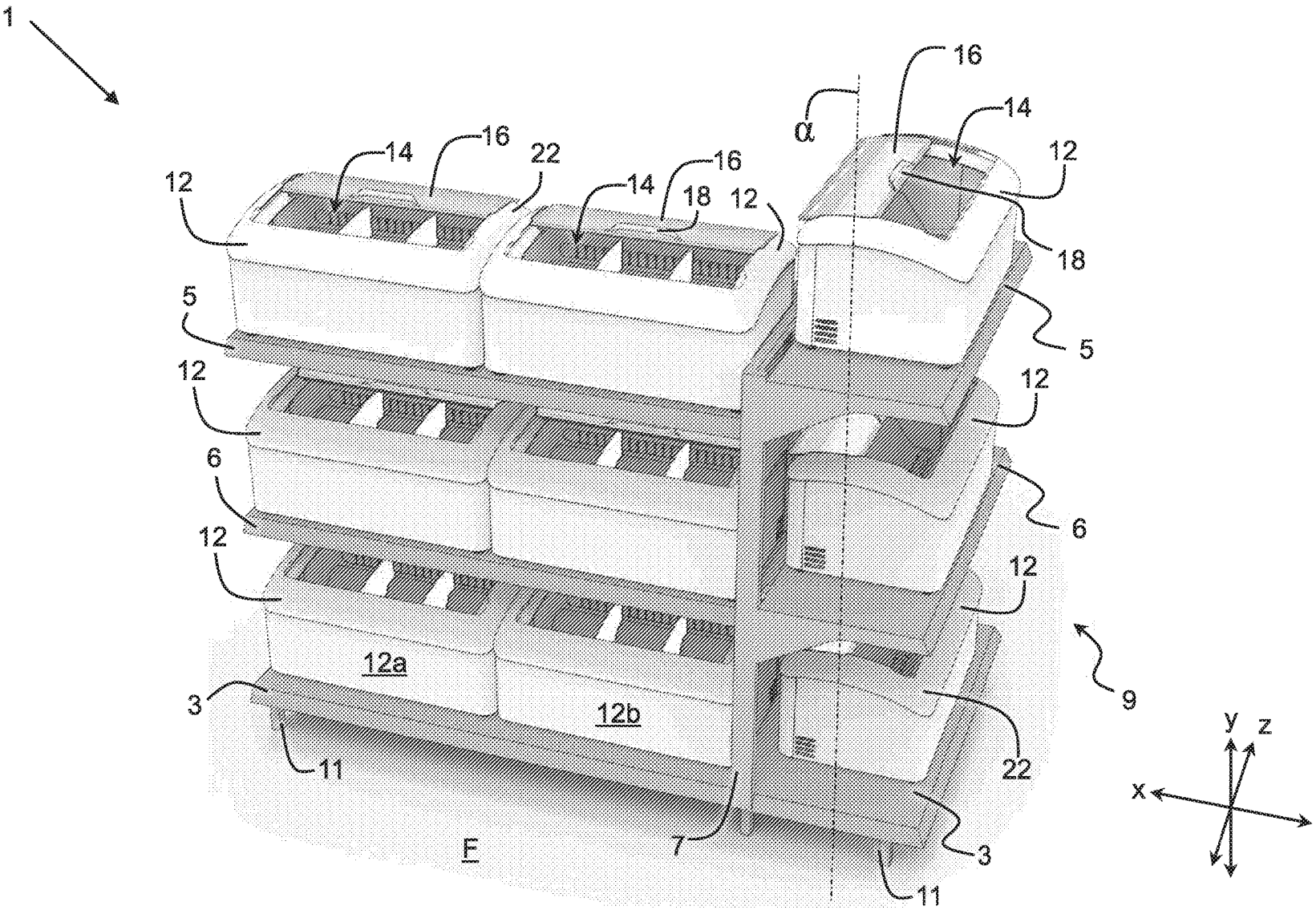
FIG. 2 illustrates a perspective view of the exemplary merchandise display of FIG. 1 with opened doors.

FIGS. 1 and 2 illustrate perspective views of an exemplary merchandise display 1 for displaying, refrigerating, and dispensing containers of a frozen product along an aisle. The display 1 includes a lower shelf 3 disposed above a floor F and an upper shelf 5 disposed above the lower shelf 3 along a longitudinal axis a (parallel to the height y) of the merchandise display 1. The display 1 may also include one or more middle shelves 6.

The display 1 may further include a support portion 7 operably coupled to the lower shelf 3, the middle shelf 6, or the upper shelf 5 to form an assembly 9. The support portion 7 may be a vertical panel to which the shelves 3, 5, 6 attach or the support portion 7 and the shelves 3, 5, 6 may be unitary, etc. The support portion 7 and the shelves 3, 5, 6 may be fabricated from metal, plastic, wood, etc. In one embodiment, the display 1 includes feet 11 to support the display 1 and/or the lower shelf 3 off the floor F.

The display 1 may also include at least one refrigerating appliance 12 configured to keep the frozen product frozen (e.g., about −5° C. to 0° C.). The refrigerating appliance 12 has a refrigerating chamber 14 configured to accommodate the containers of the frozen product. The refrigerating appliance 12 may also include a transparent door 16 configured to be moved between opened and closed positions to expose and close, respectively, the refrigerating chamber 14. The door 16 may include a handle 18 to help a user open and close the door 16. The transparent door 16 is generally on the top of the appliance 12 and, when closed as seen in FIG. 1, may decline as it extends from the rear to the front of the refrigerating appliance 12 such that the frozen product containers in the chamber 14 may be at least partially visible through the transparent door 16 from a location in front of the merchandise display 1.

The refrigerating appliance 12 may also include a bumper or protruding portion 22 to maintain adequate space above or below the protruding portion 22 between refrigerating appliances 12 located side-by-side (see, for example, appliances 12*a* and 12*b* in FIGS. 1 and 2) or between a refrigerating appliance 12 and a lateral surface (see, for example, appliance 12*b* and support portion 7).

The appliances 12 may be disposed on the lower, middle, or upper shelves 3, 5, 6 in many combinations. For example, a first refrigerating appliance 12 may be disposed on the lower shelf 3 and a second refrigerating appliance 12 may be disposed on the upper shelf 5. In another example, a first refrigerating appliance 12 may be disposed on the lower shelf 3 and second and third refrigerating appliances may be disposed on the upper shelf 5. In yet another example, first and second refrigerating appliances 12 may be disposed on the lower shelf 3 and third and fourth refrigerating appliances 12 may be disposed on the upper shelf 5. In one more example, first and second refrigerating appliances 12 may be disposed on the lower shelf 3, third and fourth refrigerating appliances 12 may be disposed on the middle shelf 6, and fifth and sixth refrigerating appliances 12 may be disposed on the upper shelf 5.

FIG. 1 illustrates a display 1 with the doors 16 in the closed position while FIG. 2 illustrates the display 1 with the doors 16 in the open position. The door 16 of the refrigerating appliance 12 may be moved between opened and closed positions to expose and close, respectively, the refrigerating chamber 14 while remaining within a set footprint or radial envelope of the display 1. That is, radial extent of the display 1 from the longitudinal axis a does not change from opening or closing the door 16. Because radial extent of the display 1 from the longitudinal axis a does not change from opening or closing the door 16, the display 1 may be located along a relatively narrow aisle such as a check-out aisle in a grocery store. In this setting, the display 1 does not impede traffic through the relatively narrow aisle.

As illustrated in FIG. 2, once the door 16 is in the open position, a consumer may insert his hand in the chamber 14 to grab a container and remove it from the chamber 14. In one embodiment, the refrigerating appliance 12 may be located, for example, on the lower shelf 3. In this case, a bottom side of the upper shelf 5 or the middle shelf 6 immediately above the refrigerating appliance 12 may be spaced from the top of the refrigerating appliance 12 along the longitudinal axis a to allow a customer's hand to reach through the opening formed when the transparent door 16 is in the open position of FIG. 2 to reach a container of the frozen product inside the chamber 14. In one embodiment, the transparent door 16 moving from the closed position of FIG. 1 to the open position of FIG. 2 or vice versa does not increase a maximum height y of the refrigerating appliance 12.

Figure 3:
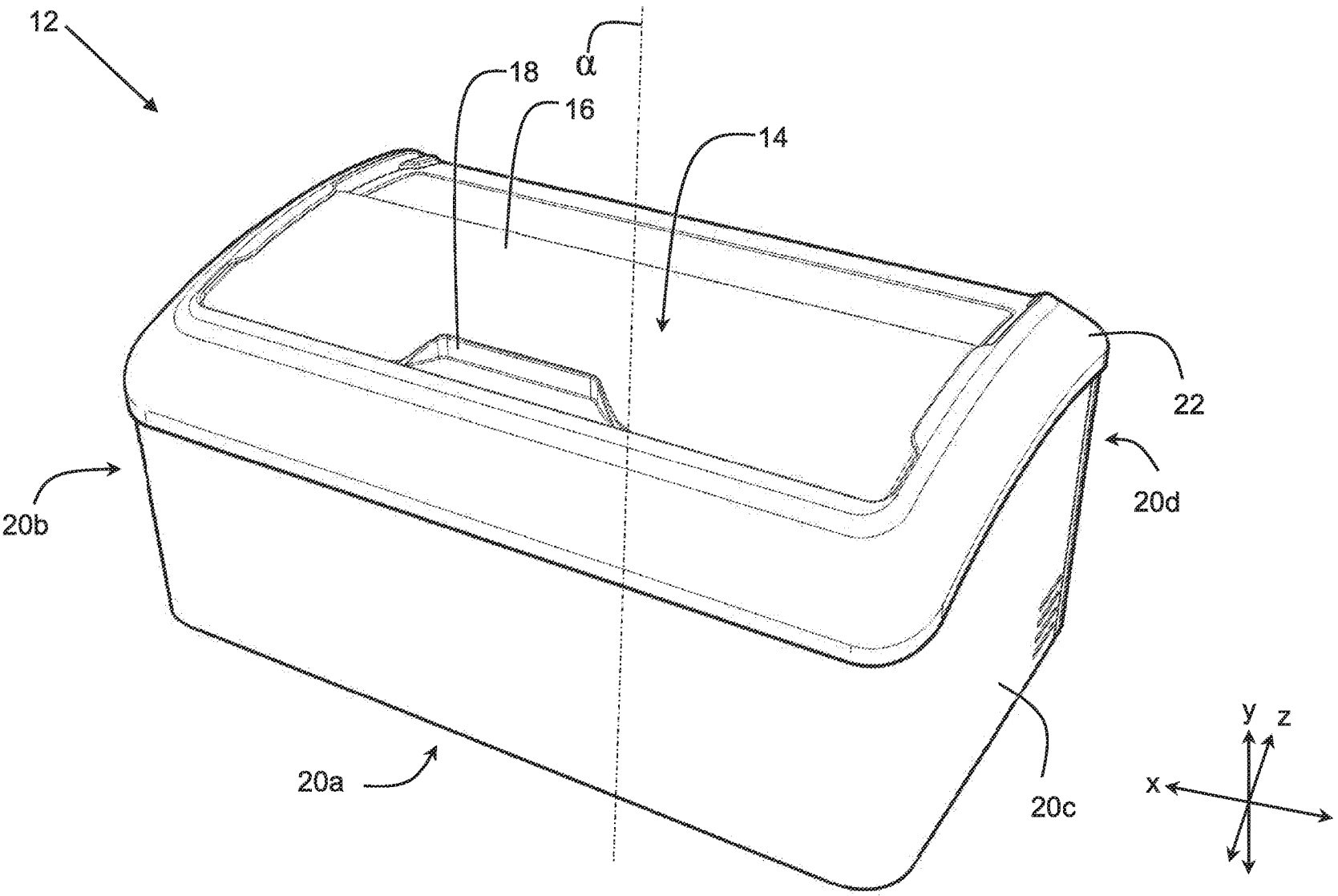
FIG. 3 illustrates a perspective view of a refrigerating appliance which is part of the display of FIG. 1, with closed doors.
Figure 4:
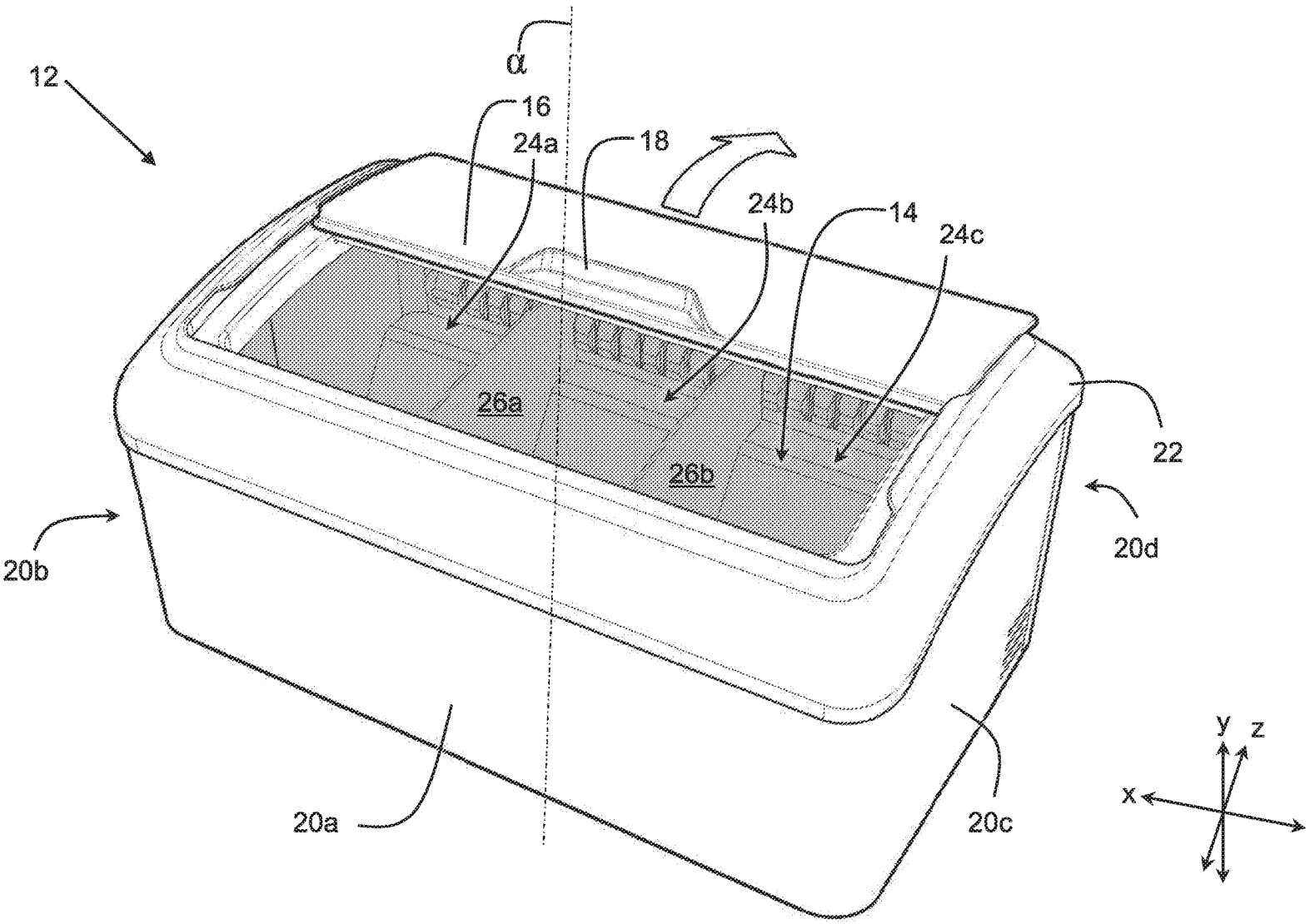
FIG. 4 illustrates a perspective view of the refrigerating appliance of FIG. 3 with opened doors.

FIGS. 3 and 4 illustrate perspective views of the refrigerating appliance 12, part of the display 1 for displaying, refrigerating, and dispensing containers of a frozen product along an aisle. The refrigerating appliance 12 is configured to keep the frozen product frozen. Thus, the refrigerating appliance 12 may include a cooling system including, for example, a compressor, condenser, fan, metering device, evaporator, etc.

The refrigerating appliance 12 also includes an enclosure 20 enclosing at least front 20*a*, left 20*b*, right 20*c*, and rear 20*d* sides of the refrigerating appliance 12. The refrigerating appliance 12 has a refrigerating chamber 14 that accommodates the containers of the frozen product. The refrigerating appliance 12 may also include a transparent door 16 configured to be moved between opened and closed positions to expose and close, respectively, the refrigerating chamber 14. The door 16 may include a handle 18 to help a user open and close the door 16. The transparent door 16 is on the top of the appliance 12 and, when closed as seen in FIG. 3, may decline as it extends from the rear 20*d* to the front 20*a* of the refrigerating appliance 12 such that a majority of a front side of one of the containers in the chamber 14 is visible through the transparent door 16 from a location in front of the merchandise display 1. In one embodiment, the door 16 is not transparent but opaque.

As shown in FIGS. 1 and 2, the refrigerating appliances 12 may be disposed side-by-side on the lower 3, middle 6, or upper shelf 5. The refrigerating appliance 12 may include on the left side 20*b*, the right side 20*c*, or the rear side 20*d* a bumper or protruding portion 22 that extends radially from the longitudinal axis a. The bumper or protruding portion 22 may serve to maintain adequate space above or below the protruding portion 22 between refrigerating appliances 12 located side-by-side or between a refrigerating appliance 12 and immediately adjacent lateral surface.

FIG. 3 illustrates the refrigerating appliance 12 with the door 16 in the open position while FIG. 4 illustrates the refrigerating appliance 12 with the door 16 in the closed position. The door 16 of the refrigerating appliance 12 may be moved between opened and closed positions to expose and close, respectively, the refrigerating chamber 14 while remaining within a set footprint or radial envelope of the display 1. That is, radial extent of the display 1 from the longitudinal axis a does not change from opening or closing the door 16.

Figure 5:
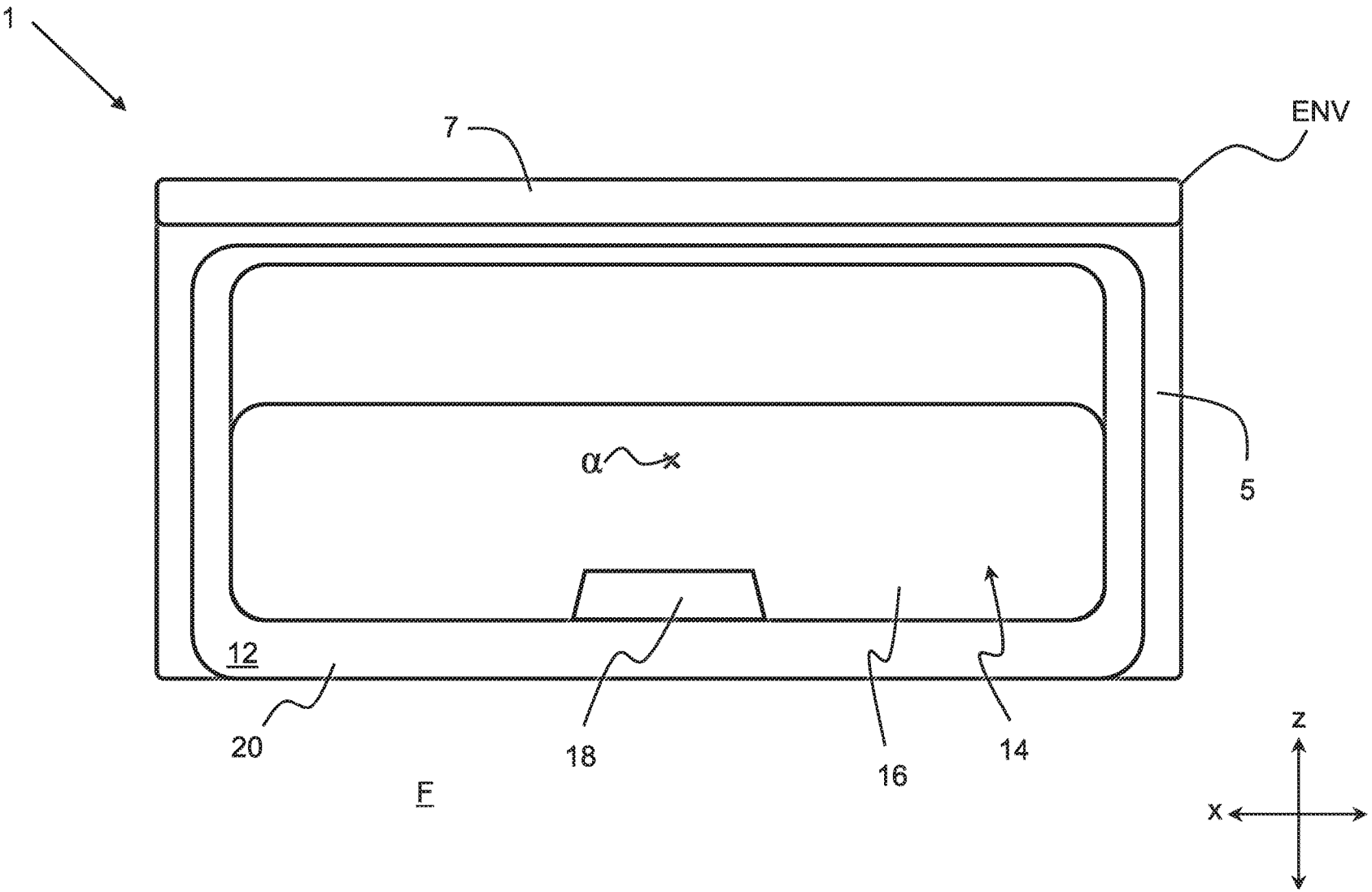
FIG. 5 illustrates a top view of the exemplary merchandise display of FIG. 1 with closed doors.
Figure 6:
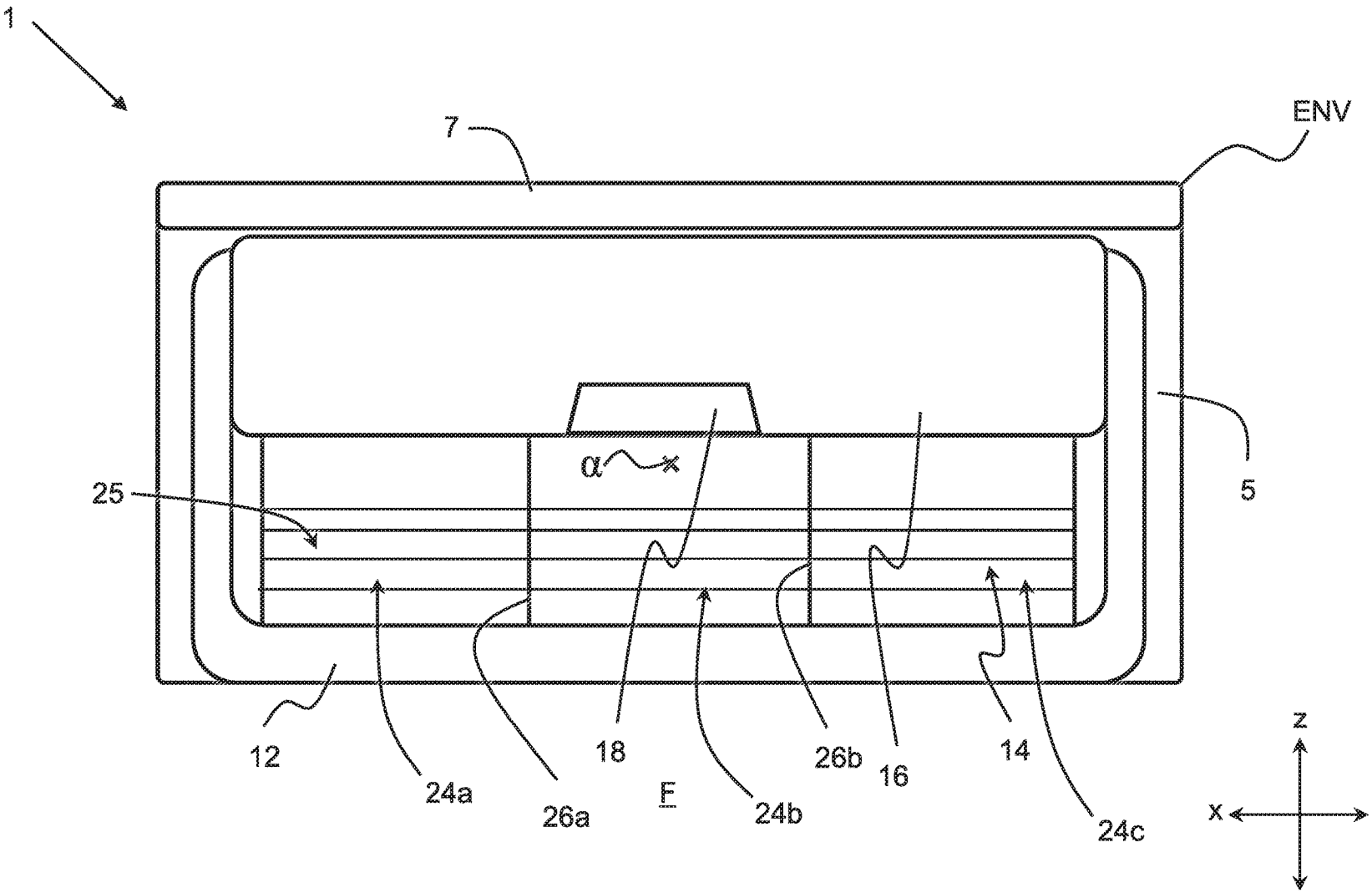
FIG. 6 illustrates a top view of the exemplary merchandise display of FIG. 1 with opened doors.
Figure 7:
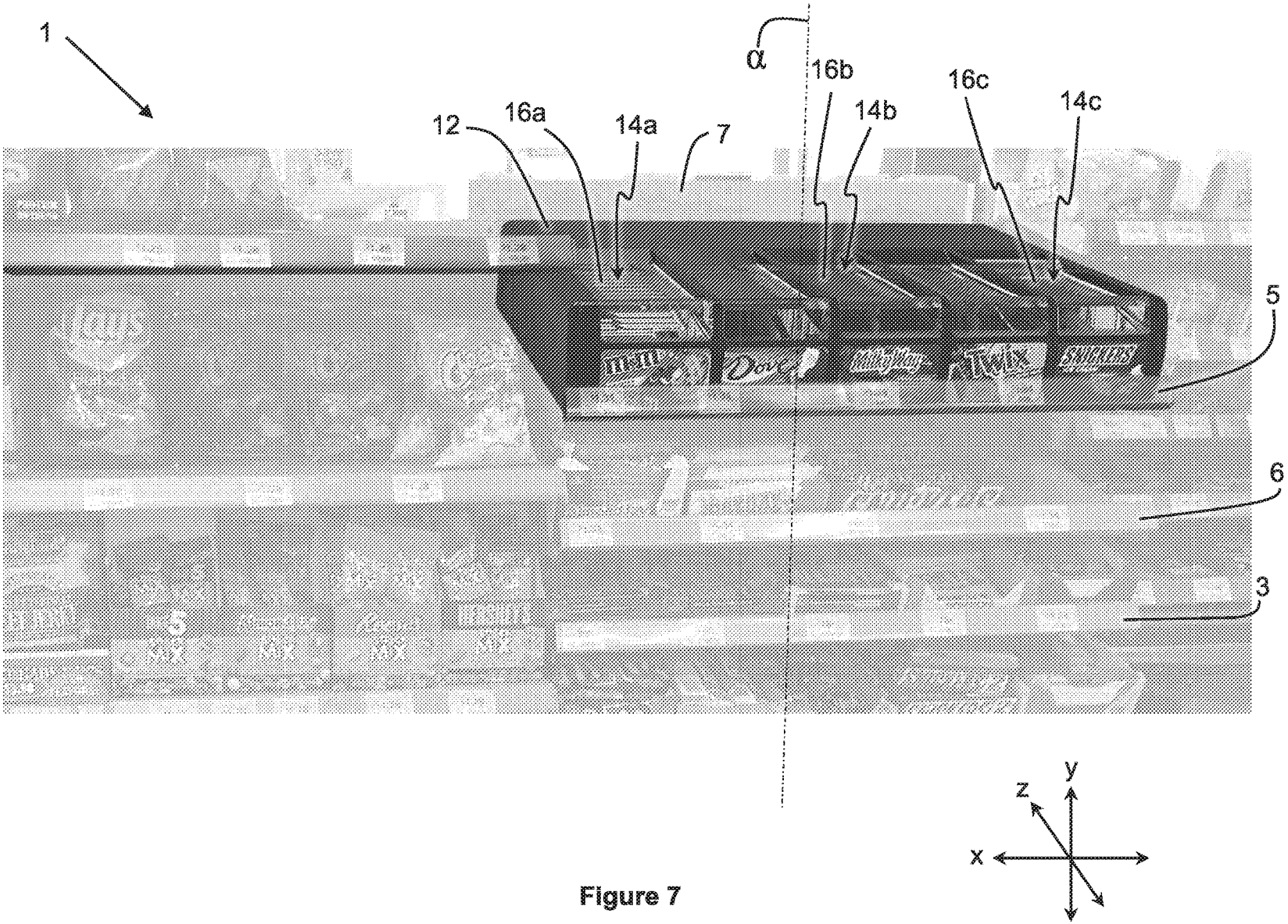
FIG. 7 illustrate a perspective view of another embodiment of an exemplary merchandise display.

FIGS. 5 and 6 illustrate a top view of the exemplary merchandise display 1 for displaying, refrigerating, and dispensing containers of a frozen product along an aisle. The display 1 includes a lower shelf 3 disposed above a floor F and an upper shelf 5 disposed above the lower shelf 3 along a longitudinal axis a of the merchandise display 1. The display 1 may also include one or more middle shelves 6.

The display 1 may further include the support portion 7 operably coupled to the lower shelf 3, the middle shelf 6, or the upper shelf 5 to form an assembly. The display 1 may also include at least one refrigerating appliance 12 configured to keep the frozen product frozen. The appliance 12 may be disposed on the lower, middle, or upper shelves 3, 5, 6. The refrigerating appliance 12 has the refrigerating chamber 14 configured to accommodate the containers of the frozen product. The refrigerating appliance 12 may also include a transparent door 16 configured to be moved between opened and closed positions to expose and close, respectively, the refrigerating chamber 14. The door 16 may include a handle 18 to help a user open and close the door 16. The transparent door 16, when closed as seen on FIG. 2, may decline as it extends from the rear to the front of the refrigerating appliance 12 such that a majority of a front side of one of the containers disposed on the first or second channel is visible through the transparent door from a location in front of the merchandise FIG. 5 illustrates a display 1 with the doors 16 in the closed position while FIG. 6 illustrates the display 1 with the doors 16 in the opened position. The door 16 of the refrigerating appliance 12 may be moved between opened and closed positions to expose and close, respectively, the refrigerating chamber 14 while remaining within a set footprint or radial envelope ENV of the display 1. That is, radial extent of the display 1 from the longitudinal axis a does not change from opening or closing the door 16. Note that from FIG. 5, in which the door 16 is closed, to FIG. 6, in which the door 16 is open, the enclosure 20, and the door 16 remain within the envelope ENV of the merchandise display 1.

As best seen in FIGS. 4 and 6, the refrigerating chamber 14 may include multiple channels 24*a*, 24*b*, 24*c* extending along a depth z of the refrigerating appliance 12. As best seen in FIG. 4, the channels 24*a*, 24*b*, and 24*c* may decline as they extend from a rear 20*d* to a front 20*a* of the refrigerating appliance 12. The first 24*a*, second 24*b*, and third 24*c* channels are laterally adjacent each other and may have ridges 25 extending along the width x of the refrigerating appliance 12 to prevent the frozen product containers from sliding along the depth z of the refrigerating appliance 12. The channels 24*a*, 24*b*, and 24*c* may be delineated by vertical channel plates 26*a*, 26*b*. The channel plates 26*a*, 26*b* may be mountable to the interior of the refrigerating chamber 14 to form the channels 24*a*, 24*b*, and 24*c*. The channel plates 26*a*, 26*b* may be horizontally adjustable to change a width x of the channels 24*a*, 24*b*, and 24*c* to adjust to different sizes of frozen product containers.

As best seen in FIG. 4, the door 16 is on top of the appliance 12 and the channels 24*a*, 24*b*, and 24*c* may decline as they extend from a rear 20*d* to a front 20*a* of the refrigerating appliance 12. This configuration allows for efficient use of space in the refrigerating appliance 12 and the display 1. For example, refrigerating machinery (e.g., compressor, condenser, fan, metering device, evaporator, etc.) of the appliance 12 may be located towards the rear 20*d* of the appliance 12 under the channels 24*a*, 24*b*, and 24*c* because the channels decline as they extend from the rear 20*d* to the front 20*a* of the refrigerating appliance 12 creating a pocket of space at the rear 20*d*. This is a very efficient use of space that allows for a significant number of containers to be stored deep in the chamber 14 from rear 20*d* to front 20*a* while the containers may all be seen by a consumer standing in front of the display 1.

FIGS. 7 and 8A-8C illustrate perspective views of a second embodiment of the exemplary merchandise display 1 for displaying, refrigerating, and dispensing containers 30 of a frozen product along an aisle. The display 1 includes a lower shelf 3 disposed above a floor and an upper shelf 5 disposed above the lower shelf 3 along a longitudinal axis a (parallel to the height y) of the merchandise display 1. The display 1 may also include one or more middle shelves 6.

The display 1 may further include a support portion 7 operably coupled to the lower shelf 3, the middle shelf 6, and the upper shelf 5. The support portion 7 may be a vertical panel to which the shelves 3, 5, 6 attach or the support portion 7 and the shelves 3, 5, 6 may be unitary, etc. The support portion 7 and the shelves 3, 5, 6 may be fabricated from metal, plastic, wood, etc.

The display 1 may also include at least one refrigerating appliance 12 configured to keep the frozen product frozen (e.g., about −5° C. to 0° C.). The refrigerating appliance 12 has a refrigerating chamber 14 configured to accommodate the containers 30 of the frozen product. The refrigerating appliance 12 may also include a transparent door 16 configured to be moved between opened and closed positions to expose and close, respectively, the refrigerating chamber 14. The door 16 may include a handle 18 to help a user open and close the door 16. The appliance 12 may be disposed on the lower, middle, or upper shelves 3, 5, 6 in many combinations.

In contrast with the embodiment of FIGS. 1 and 2, in the embodiment of FIGS. 7 and 8A-8C the appliance 12 includes three chambers/channels 14 and three corresponding doors 16. In the embodiment of FIGS. 1 and 2, a consumer opening the single door 16 would gain access to the single chamber 14 and all three channels 24*a*, 24*b*, and 24*c*. In the embodiment of FIGS. 7 and 8A-8C, a consumer opening any of the doors 16*a*, 16*b*, 16*c* would gain access to the corresponding chamber/channel 14*a*, 14*b*, 14*c* only.

Figures 8A, 8B, 8C:
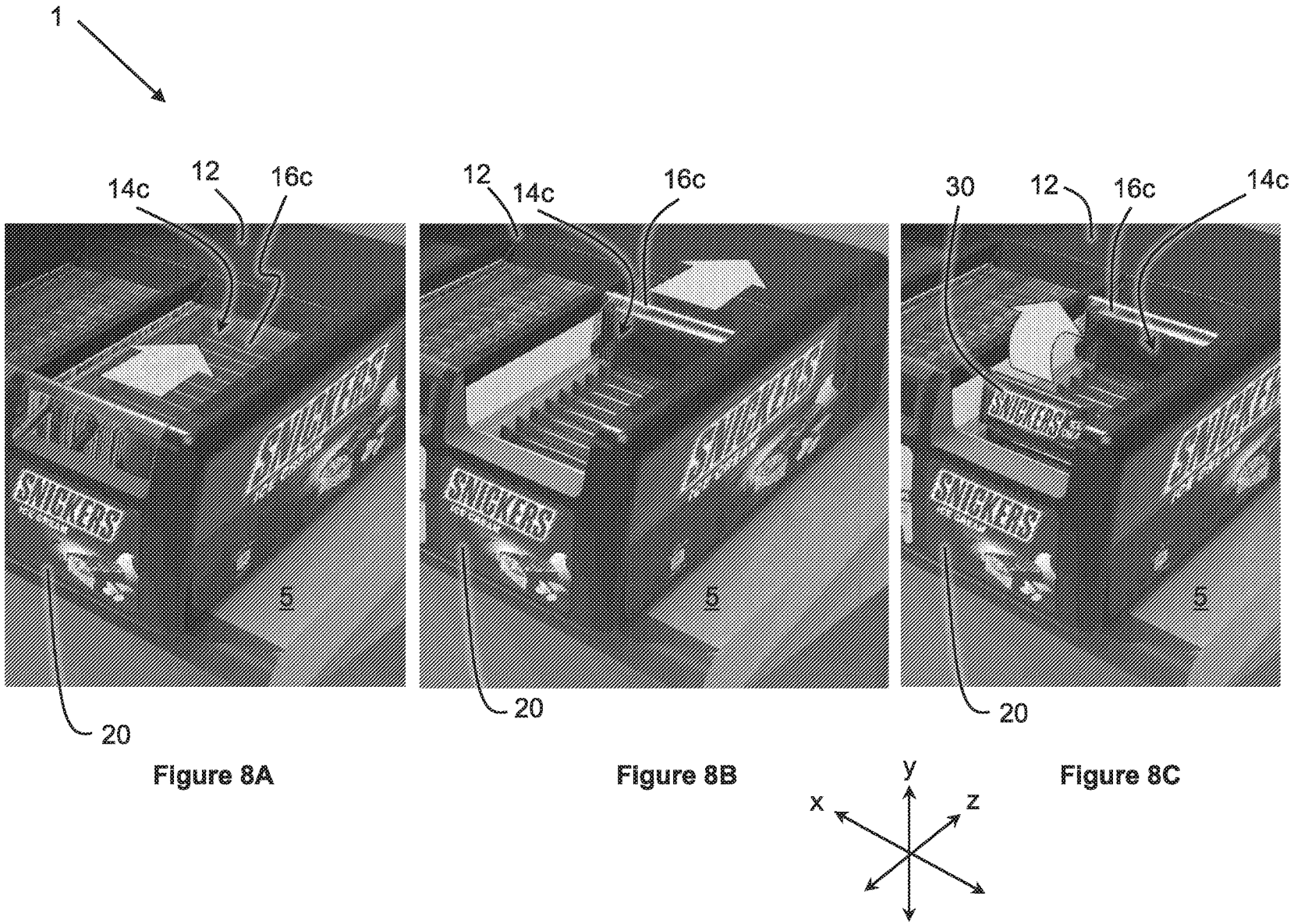
FIGS. 8A-8C illustrate perspective views of the exemplary merchandise display of FIG. 7 with a closed door, with an opened door, and with a frozen product container being removed, respectively.

FIG. 8A illustrates a display 1 with the door 16*c* in the closed position while FIG. 8B illustrates the display 1 with the door 16*c* in the open position. The door 16*c* of the refrigerating appliance 12 may be moved between opened and closed positions to expose and close, respectively, the refrigerating chamber 14*c* while remaining within a set footprint or radial envelope of the display 1. That is, radial extent of the display 1 from the longitudinal axis a does not change from opening or closing the door 16*c*.

As illustrated in FIG. 8C, once the door 16*c* is in the open position, a consumer may insert his hand in the chamber 14*c* to grab a container 30 to remove it from the chamber 14*c*. The refrigerating appliance 12 may be located, for example, on the lower shelf 3. In this case, a bottom side of the upper shelf 5 or the middle shelf 6 immediately above the refrigerating appliance 12 may be spaced from the top of the refrigerating appliance 12 along the longitudinal axis a to allow a customer's hand to reach through the opening formed when the transparent door 16*c* is in the open position to reach a container 30 of the frozen product inside the chamber 14*c*. The transparent door 16*c* moving from the closed position of FIG. 8A to the open position of FIG. 8B or vice versa does not increase a maximum height y of the refrigerating appliance 12.

Definitions

The following includes definitions of selected terms employed herein. The definitions include various examples or forms of components that fall within the scope of a term and that may be used for implementation. The examples are not intended to be limiting. Both singular and plural forms of terms may be within the definitions.

As used herein, an "operable connection" or "operable coupling," or a connection by which entities are "operably connected" or "operably coupled" is one in which the entities are connected in such a way that the entities may perform as intended. An operable connection may be a direct connection or an indirect connection in which an intermediate entity or entities cooperate or otherwise are part of the connection or are in between the operably connected entities. In the context of signals, an "operable connection," or a connection by which entities are "operably connected," is one in which signals, physical communications, or logical communications may be sent or received. Typically, an operable connection includes a physical interface, an electrical interface, or a data interface, but it is to be noted that an operable connection may include differing combinations of these or other types of connections sufficient to allow operable control. For example, two entities can be operably connected by being able to communicate signals to each other directly or through one or more intermediate entities like a processor, operating system, a logic, software, or other entity. Logical or physical communication channels can be used to create an operable connection.

"Signal," as used herein, includes but is not limited to one or more electrical or optical signals, analog or digital signals, data, one or more computer or processor instructions, messages, a bit or bit stream, or other means that can be received, transmitted, or detected.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A merchandise display for displaying, refrigerating, and dispensing containers of a frozen product along an aisle, comprising:

a lower shelf disposed above a floor and an upper shelf disposed above the lower shelf along a longitudinal axis of the merchandise display;

a support portion operably coupled to the lower shelf and the upper shelf to form an assembly, wherein a radial envelope of the merchandise display is formed by a radial extent of the assembly from the longitudinal axis; and a plurality of refrigerating appliances configured to keep the frozen product frozen and disposed on the lower shelf or the upper shelf, wherein each refrigerating appliance includes a bottom surface, a left side, a right side, a rear side within the radial envelope, and each refrigerating appliance including:

an enclosure enclosing the bottom surface, left side, right side, and rear side of the refrigerating appliance, a refrigerating chamber disposed within the enclosure and configured to accommodate the containers of the frozen product, refrigerating machinery disposed within the enclosure in communication with the refrigerating chamber, a transparent door configured to be moved between opened and closed positions to expose and close, respectively, the refrigerating chamber while the enclosure, refrigerating chamber, and transparent door remain within the radial envelope of the merchandise display, and a protruding portion that extends radially around a perimeter of the transparent door, wherein each transparent door is configured to actuate towards and beyond the rear side of each respective refrigerating appliance when the transparent door is moved from the closed position to the opened position.

2. The merchandise display of claim 1, wherein the plurality of refrigerating appliances includes first and second refrigerating appliances, the first refrigerating appliance disposed on the lower shelf and the second refrigerating appliance disposed on the upper shelf.

3. The merchandise display of claim 1, wherein the plurality of refrigerating appliances includes first, second, and third refrigerating appliances, the first refrigerating appliance disposed on the lower shelf and the second and third refrigerating appliances disposed on the upper shelf, wherein while the second and third refrigerating appliances are disposed side by side, the protruding portion on the right side of the second refrigerating appliance and the protruding portion on the left side of the third refrigerating appliance maintain a space between the second and third refrigerating appliances.

4. The merchandise display of claim 1, wherein the plurality of refrigerating appliances includes first, second, third, and fourth refrigerating appliances, the first and second refrigerating appliances disposed on the lower shelf and the third and fourth refrigerating appliances disposed on the upper shelf.

5. A merchandise display for displaying, refrigerating, and dispensing containers of a frozen product along an aisle, comprising:

at least one shelf disposed above a floor along a longitudinal axis of the merchandise display;

a support portion operably coupled to the at least one shelf to form an assembly, wherein a radial envelope of the merchandise display is formed by a radial extent of the assembly from the longitudinal axis; and a plurality of refrigerating appliances configured to keep the frozen product frozen, disposed on the at least one shelf, wherein each refrigerating appliance includes a bottom surface, a left side, a right side, and a rear side within the radial envelope, and each refrigerating appliance including:

an enclosure enclosing the bottom surface, left side, right side, and rear side of the refrigerating appliance, a refrigerating chamber disposed within the enclosure and configured to accommodate the containers of the frozen product, refrigerating machinery disposed within the enclosure in communication with the refrigerating chamber, a door configured to be moved between opened and closed positions to expose and close, respectively, the refrigerating chamber while the enclosure, refrigerating chamber, and door remain within the radial envelope of the merchandise display, and a protruding portion that extends radially around a perimeter of the door, wherein each door is configured to actuate towards and beyond the rear side of each respective refrigerating appliance when the door is moved from the closed position to the opened position.

6. The merchandise display of claim 5, wherein the plurality of refrigerating appliances includes first and second refrigerating appliances disposed side by side on the at least one shelf, the right side or the left side of the enclosure of the first refrigerating appliance or the second refrigerating appliance having the protruding portion extends radially to:

a. while the first and second refrigerating appliances are disposed side by side touching each other, maintain space between the first and second refrigerating appliances above or below the protruding portion, and b. while the merchandise display is disposed immediately adjacent a lateral surface, maintain space between the first refrigerating appliance or the second refrigerating appliance and the lateral surface above or below the protruding portion.

7. A merchandise display for displaying, refrigerating, and dispensing containers of a frozen product along an aisle, comprising:

a lower shelf disposed above a floor and an upper shelf disposed above the lower shelf along a longitudinal axis of the merchandise display;

a support portion operably coupled to the lower shelf and the upper shelf to form an assembly, wherein a radial envelope of the merchandise display is formed by a radial extent of the assembly from the longitudinal axis; and at least one refrigerating appliance configured to keep the frozen product frozen, disposed on the lower shelf or the upper shelf, wherein the at least one refrigerating appliance includes a bottom surface, a left side, a right side, a rear side within the radial envelope, and each of the at least one refrigerating appliance including:

an enclosure enclosing the bottom surface, left side, right side, and rear side of the refrigerating appliance, a refrigerating chamber disposed within the enclosure and configured to accommodate the containers of the frozen product, refrigerating machinery disposed within the enclosure in communication with the refrigerating chamber, a transparent door configured to be moved between opened and closed positions to expose and close, respectively, the refrigerating chamber while the enclosure, refrigerating chamber, and transparent door remain within the radial envelope of the merchandise display, and a protruding portion that extends radially around a perimeter of the transparent door;

wherein each transparent door is configured to actuate towards and beyond the rear side of each respective refrigerating appliance when the transparent door is moved from the closed position to the opened position.

8. The merchandise display of claim 7, wherein the at least one refrigerating appliance includes first and second refrigerating appliances, the first refrigerating appliance disposed on the lower shelf and the second refrigerating appliance disposed on the upper shelf.

9. The merchandise display of claim 7, wherein the at least one refrigerating appliance includes first, second, and third refrigerating appliances, the first refrigerating appliance disposed on the lower shelf and the second and third refrigerating appliances disposed on the upper shelf.

10. The merchandise display of claim 7, wherein the at least one refrigerating appliance includes first, second, third, and fourth refrigerating appliances, the first and second refrigerating appliances disposed on the lower shelf and the third and fourth refrigerating appliances disposed on the upper shelf.

11. The merchandise display of claim 7, wherein the at least one refrigerating appliance includes first and second refrigerating appliances disposed side by side on the lower shelf or the upper shelf, the right side or the left side of the enclosure of the first refrigerating appliance or the second refrigerating appliance having the protruding portion that extends radially to, while the first and second refrigerating appliances are disposed side by side touching each other, maintain space between the first and second refrigerating appliances above or below the protruding portion.

12. The merchandise display of claim 7, the right side or the left side of the enclosure of the at least one refrigerating appliance having the protruding portion that extends radially to, while the merchandise display is disposed immediately adjacent a lateral surface, maintain space between the at least one refrigerating appliance and the lateral surface above or below the protruding portion.

13. The merchandise display of claim 7, wherein the refrigerating chamber includes a first channel extending along a depth of the at least one refrigerating appliance and a second channel laterally adjacent the first channel, each of the first channel and the second channel having ridges extending along a width of the at least one refrigerating appliance to prevent the containers from sliding along the depth of the at least one refrigerating appliance.

14. The merchandise display of claim 7, wherein the refrigerating chamber includes first and second channels extending adjacent each other along a depth of the at least one refrigerating appliance and declining as they extend from a rear to a front of the at least one refrigerating appliance.

15. The merchandise display of claim 7, wherein the at least one refrigerating appliance includes vertical channel plates horizontally adjustably mountable to an interior of the refrigerating chamber to form first and second channels extending adjacent each other along a depth of the at least one refrigerating appliance.

16. The merchandise display of claim 7, wherein the at least one refrigerating appliance includes vertical channel plates mountable to an interior of the refrigerating chamber to form first and second channels extending adjacent each other along a depth of the at least one refrigerating appliance, the vertical channel plates mountable to various positions along a width of the refrigerating chamber to vary a width of the first and second channels to accommodate various sizes of the containers.

17. The merchandise display of claim 7, wherein the refrigerating chamber includes first and second channels extending adjacent each other along a depth of the at least one refrigerating appliance and declining as they extend from a rear to a front of the at least one refrigerating appliance, the transparent door, when closed, declining as it extends from the rear to the front of the at least one refrigerating appliance such that a majority of a front side of one of the containers disposed on the first or second channel is visible through the transparent door from a location in front of the merchandise display.

18. The merchandise display of claim 7, wherein the transparent door, when closed, declines as it extends from a rear to a front of the at least one refrigerating appliance such that a majority of a front side of one of the containers disposed in the refrigerating chamber is visible through the transparent door from a location in front of the merchandise display.

19. The merchandise display of claim 7, wherein the at least one refrigerating appliance is disposed on the lower shelf and a bottom side of the upper shelf is spaced from a top of the refrigerating appliance along the longitudinal axis to allow a customer's hand to reach through an opening formed when the transparent door is in the opened position to reach a container of the frozen product disposed within the refrigerant chamber.

20. The merchandise display of claim 7, wherein the transparent door moving from the closed position to the opened position or vice versa does not increase a maximum height of the at least one refrigerating appliance.

* * * * *